US007114529B2

(12) United States Patent
Johnson et al.

(10) Patent No.: US 7,114,529 B2
(45) Date of Patent: Oct. 3, 2006

(54) MULTILAYER THROUGH-AIR DRYER FABRIC

(75) Inventors: Dale B. Johnson, Ottawa (CA); James Harrison, Kanata (CA)

(73) Assignee: AstenJohnson, Inc., Charleston, SC (US)

( * ) Notice: Subject to any disclaimer, the term of this patent is extended or adjusted under 35 U.S.C. 154(b) by 256 days.

(21) Appl. No.: 10/482,182

(22) PCT Filed: Jul. 9, 2002

(86) PCT No.: PCT/US02/21531

§ 371 (c)(1),
(2), (4) Date: Dec. 23, 2003

(87) PCT Pub. No.: WO03/006732

PCT Pub. Date: Jan. 23, 2003

(65) Prior Publication Data

US 2004/0182466 A1 Sep. 23, 2004

Related U.S. Application Data

(60) Provisional application No. 60/304,063, filed on Jul. 9, 2001.

(51) Int. Cl.
*D21F 3/00* (2006.01)

(52) U.S. Cl. ..... 139/383 A; 439/383 R; 442/203; 442/205; 162/358.2; 162/902

(58) Field of Classification Search ..... 139/383 A, 139/383 R; 442/203, 205; 162/358.1, 358.2, 162/902, 903

See application file for complete search history.

(56) References Cited

U.S. PATENT DOCUMENTS 4,239,065 A 12/1980 Trokhan
4,290,209 A 9/1981 Buchanan et al.
4,501,303 A * 2/1985 Osterberg ..... 139/425 A
5,429,686 A 7/1995 Chiu et al.
5,544,678 A * 8/1996 Barrett ..... 139/383 A
5,672,248 A 9/1997 Wendt
5,746,887 A 5/1998 Wendt
5,881,764 A * 3/1999 Ward ..... 139/383 A
6,004,440 A 12/1999 Hay
6,017,417 A 1/2000 Wendt
6,110,324 A 8/2000 Trokhan
6,237,644 B1 5/2001 Hay
6,240,973 B1 * 6/2001 Stone et al. ..... 139/383 A
6,334,467 B1 * 1/2002 Barrett et al. ..... 139/383 A
6,581,645 B1 * 6/2003 Johnson et al. ..... 139/383 A

* cited by examiner

*Primary Examiner*—John J. Calvert
*Assistant Examiner*—Robert H Muromoto
(74) *Attorney, Agent, or Firm*—Volpe and Koenig, P.C.

(57) ABSTRACT

A multilayer through-air dryer (TAD) fabric architecture having a single warp yarn system with a maximum warp fill and a weft yarn system comprised of two sets of weft yarns selected to set the warp yarn height above the weft yarns without embedment into the fabric plane, the warp and weft yarns interlacing to form diagonal apertures within the fabric to produce a high fabric air permeability for providing increased paper sheet bulk without compromising paper machine running parameters. A method of using the TAD fabric of the present invention for forming a paper sheet having increased bulk and a predetermined embossed pattern. Also, a method for manufacturing a TAD fabric to provide increased bulk and a predetermined embossed pattern of the paper sheet.

8 Claims, 14 Drawing Sheets

Photograph of paper side of fabric

Photograph of Paper Sheet from Prior Art

Photograph of paper side of fabric

Photograph of Paper Sheet from Fig. 3 fabric

20

Photograph of paper side of fabric

Photograph of Paper Sheet from Fig. 6 fabric

Photograph of paper side of fabric

Photograph of Paper Sheet made with Fig. 9 fabric

MULTILAYER THROUGH-AIR DRYER FABRIC

CROSS-REFERENCE TO RELATED APPLICATIONS

This patent application is filed as a non-provisional patent application and claims the benefit of the filing date of the following US provisional patent application, which is relied upon and is incorporated by reference in its entirety in this application:

U.S. Provisional Application No. 60/304,063, entitled "Multilayer Through-Air Dryer Fabric," filed on Jul. 9, 2001.

BACKGROUND OF THE INVENTION (1) Field of the Invention

The present invention relates generally to industrial textiles and, more particularly, to a multilayer papermakers fabric for use on through-air dryer sections of paper making machines.

(2) Description of the Prior Art

Typically, through-air drying machines employ paper machine clothing having weave designs and properties for assisting the transportation and drying of the paper sheet through that section of the machine. A through-air dryer (TAD) is a honeycomb or generally porous large diameter suction roll that follows the press section of a paper machine. It is at least partially surrounded by a hood that blows hot air. The paper sheet is carried on the TAD fabric over the periphery of the TAD cylinder; hot air from the hood impinges onto the paper sheet, passes through the sheet and the TAD fabric supporting the sheet into the porous suction roll.

Prior art TAD fabrics commonly employ single layer fabric designs, although double layer fabrics have also been known to be used. By way of example, the following prior art references are considered relevant to this application:

U.S. Pat. Nos. 5,672,248, 5,746,887, and 6,017,417, issued Sep. 30, 1997, May 5, 1998, and Jan. 25, 2000, respectively, to Wendt, et al. for Method of making soft tissue products teaches tissue products with increased cross-machine direction stretch and method for producing same. This property is imparted to the tissue by making the tissue using a throughdrying fabric having from 5 to about 300 machine direction impression knuckles per square inch that are raised above the plane of the fabric. These impression knuckles are created by an extra warp system that is "embroidered" onto a base fabric structure.

U.S. Pat. No. 5,429,686, issued Jul. 4, 1995 to Chiu, et al. for Apparatus for making soft tissue products discloses a TAD fabric having a load bearing layer and a sculpture layer. The high impression warp knuckles of this layer are created by effectively embroidering a second warp system onto a base fabric load bearing layer similar to the above-referenced patents to Wendt, et at.

U.S. Pat. No. 6,237,644, issued May 29, 2001 to Hay et al. for Tissue forming fabrics teaches a single layer lattice-shaped fabric of a design to form an embossed fibrous web. The lattice design is formed by the pattern of weaving of the single layer fabric, and requires no additional filaments or elements to form the embossed design.

U.S. Pat. No. 4,239,065, issued Dec. 16, 1980 to Trokhan for Papermachine clothing having a surface comprising a bilaterally staggered array of wicker-basket-like cavities teaches a fabric for making soft, absorbent paper of relatively low density, and relatively isotropic stretch properties when creped. The fabric is woven such that a top-surface plane is formed by coplanar crossovers of filaments and sub-top-surface crossovers are distributed in a predetermined pattern throughout the clothing.

U.S. Pat. No. 6,110,324, issued Aug. 29, 2000 to Trokhan, et al. for Papermaking belt having reinforcing piles teaches a fabric having yarns disposed, in part, to the top surface plane to form knuckles, and further including reinforcing piles that resist applied loads and may prevent deflection of the knuckles during the papermaking process.

U.S. Pat. No. 6,000,440, issued Dec. 14, 1999 to Hay for Multi-layer papermaking fabric teaches a multi-layer fabric with paperside to lower surface weft ratios greater than 1 and all paperside weft yarns interlacing with the warp yarns in an identical manner. The paperside weft yarns intermittently buttress against adjacent paperside weft yarns and possess an average lateral crimp ratio of greater than 1.62, producing a fabric having reduced fabric openness and thus an air permeability of less than 275 c.f.m./ft$^2$ (cubic feet per minute per square foot) or about 4450 m$^3$/m$^2$/h (cubic meters per square meter per hour) at ½ inch water pressure. The fabric has a reduced rate of dewatering for increasing sheet smoothness, reducing two sidedness, providing additional sheet support, and reducing void volume for minimal sheet rewetting.

However, disadvantageously, TAD fabrics of the prior art have typically not provided an optimal relationship between fabric properties such as air permeability and warp fill, and finished paper sheet properties, namely paper sheet bulk. Ideally, the paper sheet bulk is maximized without slowing the paper machine or otherwise negatively affecting the paper machine running parameters or other sheet properties.

Thus, there remains a need for an improved through-air dryer (TAD) fabric, which fabric is woven according to a selected weave pattern from a system of synthetic monofilament warp and weft yarns which is chosen to provide a warp fill in the fabric of at least 100%, sufficient air permeability for producing relatively high drying rates, and a surface topography which will contribute to increased paper sheet bulk without adversely affecting other paper machine running parameters, in particular, machine speed.

SUMMARY OF THE INVENTION

The present invention is directed to a woven multilayer industrial fabric which is particularly suitable for use in conveying a paper sheet product along through-air dryer (TAD) sections on paper machines wherein the fabric is constructed of polymeric monofilament warp and weft yarns which are interwoven according to a predetermined pattern selected to provide in the fabric: a) diagonal apertures to allow for air movement through the fabric, b) an air permeability of at least 450 cfm (cubic feet per minute per square foot) or at least about 7300 m$^3$/m$^2$/h (cubic meters per square meter per hour), (c) a warp fill of at least 100%, and d) warp yarn floats located on at least one planar surface of the fabric, namely the paper side planar surface, which are sufficiently prominent to impart their impression into the paper product being conveyed by the fabric. The fabrics of this invention will be useful in providing increased paper sheet bulk and high drying rates of a paper sheet product conveyed thereon without negatively affecting paper machine running parameters.

In a first preferred embodiment, the fabrics of this invention are comprised of a system of weft yarns consisting of two sets of weft yarns, and a system of warp yarns consisting of a single set of warp yarns. The first set of weft yarns is interwoven with both the second set of weft yarns and the system of warp yarns to provide a first generally planar fabric surface. The second set of weft yarns is interwoven with both the first set of weft yarns and the system of warp yarns so as to provide a second generally planar fabric surface which is located on the opposite side of the fabric from the first surface. The component yarns comprising the first and second sets of weft yarns are arranged in the fabric so as to be in substantially vertically alignment with respect to each other, and are interwoven with the single set of warp yarns at substantially right angles thereto. The fabric weave pattern is chosen so as to provide diagonal apertures in the woven fabric to allow for the movement of air through the fabric. The woven fabric has an air permeability of at least 450 cubic feet per minute per square foot (cfm) or at least about 7300 $m^3/m^2/h$ (cubic meters per square meter per hour), and the warp yarns are interwoven to provide a warp fill in the fabric of at least 100%, and warp yarn floats which are raised above the first generally planar fabric surface by a distance D which is from about (0.3 to 1.5)×h where h is the thickness of the warp yarn.

In a second preferred embodiment, the fabrics of this invention are comprised of a system of weft yarns consisting of two sets of weft yarns, and a system of warp yarns consisting of two sets of warp yarns which are interwoven according to a selected pattern so as to be vertically stacked in pairs in the fabric. Each pair of vertically stacked warp yarns is either: a) fully conjoined, so that both pair members follow the same weave path in the fabric and are in intimate contact throughout, or b) partially conjoined, so that each pair member follows a different weave path in the fabric which causes each member to be periodically separated from the other at selected locations within the pattern repeat. The first set of weft yarns is interwoven with both the second set of weft yarns and the system of warp yarns according to a selected weave pattern chosen to provide the first generally planar fabric surface. The second set of weft yarns is interwoven with both the first set of weft yarns and the system of warp yarns so as to provide the second generally planar fabric surface which is located opposite to the first. The component yarns comprising the first and second sets of weft yarns are arranged in the fabric so as to be in substantially vertically alignment with respect to each other, and are interwoven with the warp yarn system at substantially right angles thereto. The fabric weave pattern is selected to provide diagonal apertures in the woven fabric to allow for the movement of air. The woven fabric has an air permeability of at least 450 cubic feet per minute per square foot (cfm) or at least about 7300 $m^3/m^2/h$ (cubic meters per square meter per hour), and the warp yarns are interwoven to provide a fabric warp fill of from about 100% to 220% and warp yarn floats which are raised above the first planar surface by a distance D which is from about (0.3 to 1.5)×h where h is the thickness of the warp yarn.

The present invention is further directed to a method for making a fibrous web or paper product using a multilayer fabric for TAD sections on paper machines wherein the fabric is constructed with diagonal apertures formed within the fabric to produce a maximum warp fill of between about 100% to about 220% warp fill where stacked paired warp yarns are used, and at least 75% coverage by a weft yarn system comprised of two sets or systems of weft yarns, which warp and weft systems interlace at substantially right angles to each other in a pattern that forms a fabric plane, wherein the warp yarn float height of at least a portion of the warp yarn is maintained above the weft yarn height respective to the fabric plane with no embedment of the warp yarns, except that portion of the warp yarn at the ends of the floats, into the weft yarns and having a high air permeability for providing increased paper sheet bulk and high drying rates without negatively affecting paper machine running parameters.

The present invention is further directed to a method of manufacturing a multilayer fabric for TAD sections on paper machines wherein the fabric is constructed with diagonal apertures formed within the fabric to produce a maximum warp fill of between about 100% to about 220% warp fill where stacked paired warp yarns are used, and at least 75% coverage by a weft yarn system comprised of two sets or systems of weft yarns, which warp and weft systems interlace at substantially right angles to each other in a pattern that forms a fabric plane, wherein the warp yarn float height of at least a portion of the warp yarn is maintained above the weft yarn height respective to the paper side planar surface of the fabric with no embedment of the warp yarns, except that portion of the warp yarn at the ends of the floats, into the weft yarns and having a high air permeability for providing increased paper sheet bulk and high drying rates without negatively affecting paper machine running parameters. The warp yarn float above the fabric plane is determined according to the formula (0.3 to 1.5)×h, where h is the thickness of a rectangular warp yarn.

Preferably, the warp yarn system is comprised of one set of warp yarns. Alternatively, the warp yarn system is comprised of two sets of warp yarns which are either fully conjoined in their path through the fabric, or are partially conjoined. Preferably, the warp yarns comprising the first and second sets have a generally rectangular cross section. Alternatively, the warps yarns comprising the first and second sets are profiled so as to enhance their interconnection generally as described in copending U.S. patent application Ser. No. 10/824,829 filed Apr. 3, 2001 in the name of the assignee.

Preferably, the fabrics of the present invention will be woven using an industrial loom according to techniques well known to those of skill in the art. Alternatively, the fabrics of this invention may be assembled in the manner described in U.S. Ser. No. 10/824,829. Thus, the present invention provides an improved through-air dryer fabric, method of using, and method of making the same, having an air permeability of at least 450 cubic feet per minute per square foot ($cfm/ft^2$) or at least about 7300 $m^3/m^2/h$ (cubic meters per square meter per hour), for providing increased paper sheet bulk and high drying rates without negatively affecting paper machine running parameters.

Accordingly, one aspect of the present invention is to provide a multilayer fabric for TAD sections on paper machines wherein the fabric is constructed with diagonal apertures formed within the fabric to produce a maximum crowd factor based upon coverage by a single warp yarn system and a weft yarn system comprised of two sets of weft yarns interlacing at substantially right angles to each other in a pattern forming a fabric plane wherein the warp yarn float height is maintained above the weft yarn height respective to the fabric plane with no embedment of the warp yarns, except that portion of the warp yarn at the ends of the floats, into the weft yarns and having an air permeability for providing increased paper sheet bulk and increased drying rates without negatively affecting paper machine running parameters.

Another aspect of the present invention is to provide a method for making fibrous web or paper using the present invention, in particular by using the present invention on a TAD section of a paper machine.

Still another aspect of the present invention is to provide a method of manufacturing a multilayer fabric for TAD sections on paper machines wherein the fabric is constructed with diagonal apertures formed within the fabric to produce a maximum crowd factor based upon coverage by a single warp yarn system and a weft yarn system comprising two sets of weft yarns, the warp and weft yarns interlacing at substantially right angles to each other in a pattern forming a fabric plane wherein the warp yarn height is maintained above the weft yarn height respective to the fabric plane with no embedment of at least a portion of the warp yarns, namely that portion of the warp yarn at the ends of the floats, into the weft yarns according to the formula Warp Yarn Height=(0.3 to 1.5)×h, where h is the thickness of a rectangular warp yarn above the weft yarns, which produces a fabric having a high air permeability for providing increased paper sheet bulk and increased drying rates without negatively affecting paper machine running parameters.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
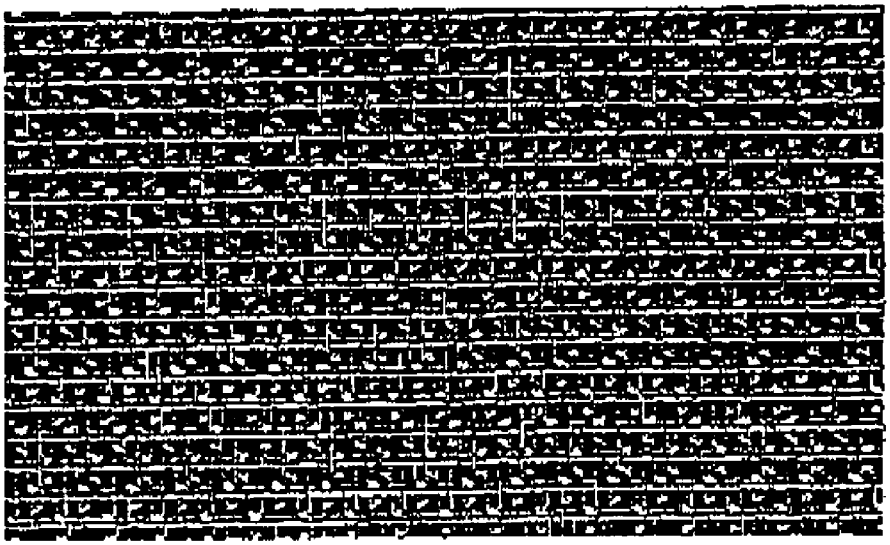
FIGURE 1 PRIOR ART
FIG. 1 is a PRIOR ART photograph of a top view of a prior art fabric.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. Additionally, the terms "cross machine direction" (CD), "machine direction" (MD), "paper side" (PS), "machine side" (MS), and "cfm" (cfm/ft2) are employed with reference to the fabric on the paper machine and are for convenience and conciseness of description and are not otherwise to be construed as limiting terms.

By way of definition, "fabric plane" refers to the generally horizontal plane formed by the PS surfaces of the weft yarns in the woven structure of the fabric; it is from this surface that the warp yarn height is measured. Also, as used herein, the term "float" refers to a portion of a yarn that passes over a group of other yarns without interweaving with them. The term embedment refers to the portion of a float that is interwoven with another yarn and is at or below the fabric plane.

As used herein the distance d is the height of the float above plane formed by the paper side surface weft yarns.

Warp fill is defined as the amount of warp in a given space relative to the total space considered, and by the equation: warp fill=(strand width)×(number of strands)/(unit fabric width)×100.

The warp yarn float height above the paper side planar surface of the fabric according to the formula:

$$\text{Warp yarn float height } (H)=(0.3 \text{ to } 1.5)\times h,$$

where h is the thickness of a rectangular warp yarn above the weft yarns on the paper side planar surface of the fabric.

Also, by way of definition, paper sheet bulk or "bulk" as referred to herein is determined by the following method: To measure sheet bulk a handsheet having a basis weight of approximately 40 g/m$^2$ is made on a fine mesh forming fabric using a specially constructed flow apparatus that gives a high degree of MD orientation in the formed sheet. The sheet is partially dried on this fabric by passing the sheet/fabric combination over a vacuum slot. The sheet is then transferred from the forming fabric to the TAD dryer fabric according to the present invention at a consistency of about 25–30% and completely dried on the TAD fabric using a combination of vacuum and impinging hot air. The apparent thickness of the sheet is measured by placing it under a platen, which is in contact with a dial gauge. The dial gauge and platen load the sample to 0.083 psi. The bulk is calculated by dividing the apparent thickness expressed in cm by the basis weight expressed in g/cm$^2$.

Figure 2:
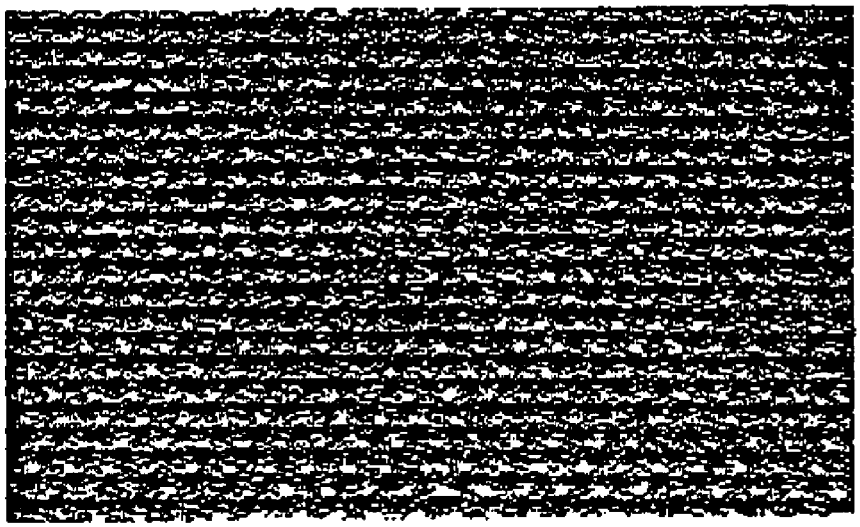
FIGURE 2 PRIOR ART
FIG. 2 is a PRIOR ART photograph of a paper sheet dried on a prior art fabric.

Referring now to the drawings in general, the illustrations are for the purpose of describing a preferred embodiment of the invention and are not intended to limit the invention thereto. FIG. 1 and FIG. 2 are photographs of the top or paper sheet side (PS) surface of a PRIOR ART TAD fabric and a paper sheet that has been dried using the same, respectively. While the sheet made using the prior art TAD fabric does show some embossing, the embossed pattern is based upon a prior art fabric having lower than 100% warp fill and short warp yarn floats on the paper sheet side surface. The warp yarn float height above the paper side planar surface of the fabric according to the formula $$\text{Warp yarn float height } (H)=(0.3 \text{ to } 1.5)\times h,$$

where h is the thickness of a rectangular warp yarn above the weft yarns on the paper side planar surface of the fabric. The resultant paper sheet has a sheet bulk of less than about 9.4 cubic centimeters per gram (cc/g).

Figure 3:
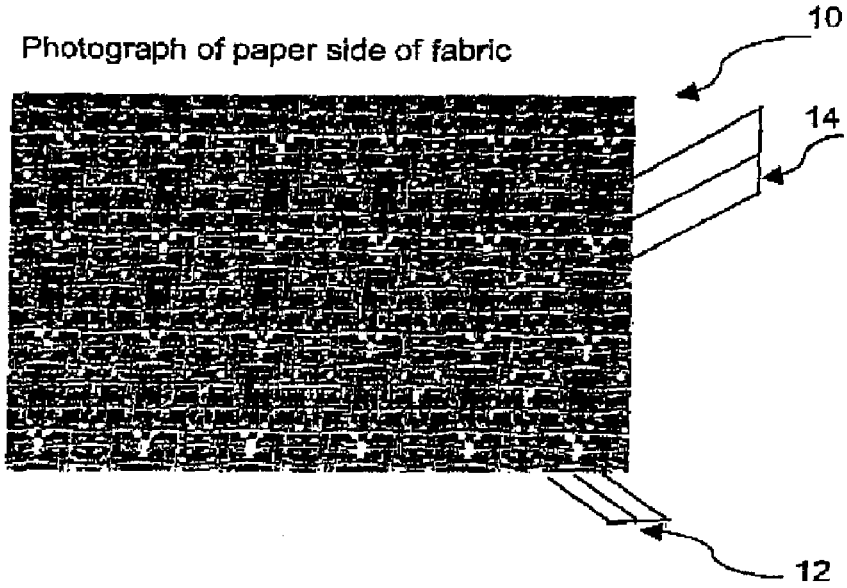
FIG. 3 is a photograph of a top view of a TAD fabric constructed according to the present invention.
Figure 4:
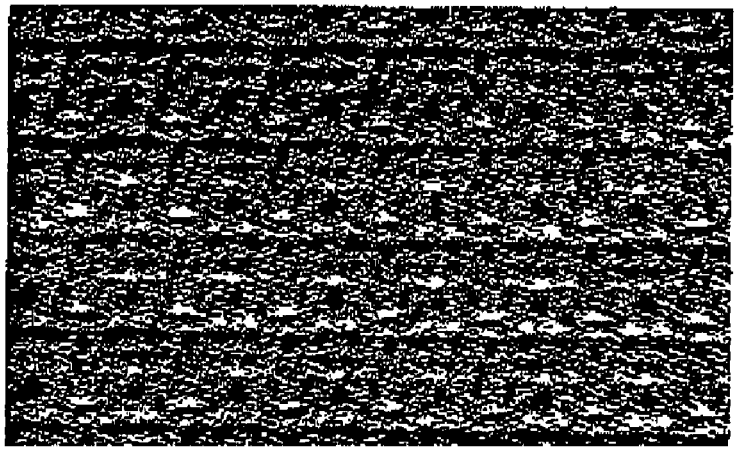
FIG. 4 is a photograph of a paper sheet dried on the TAD fabric of the present invention shown in FIG. 3.
Figure 5:
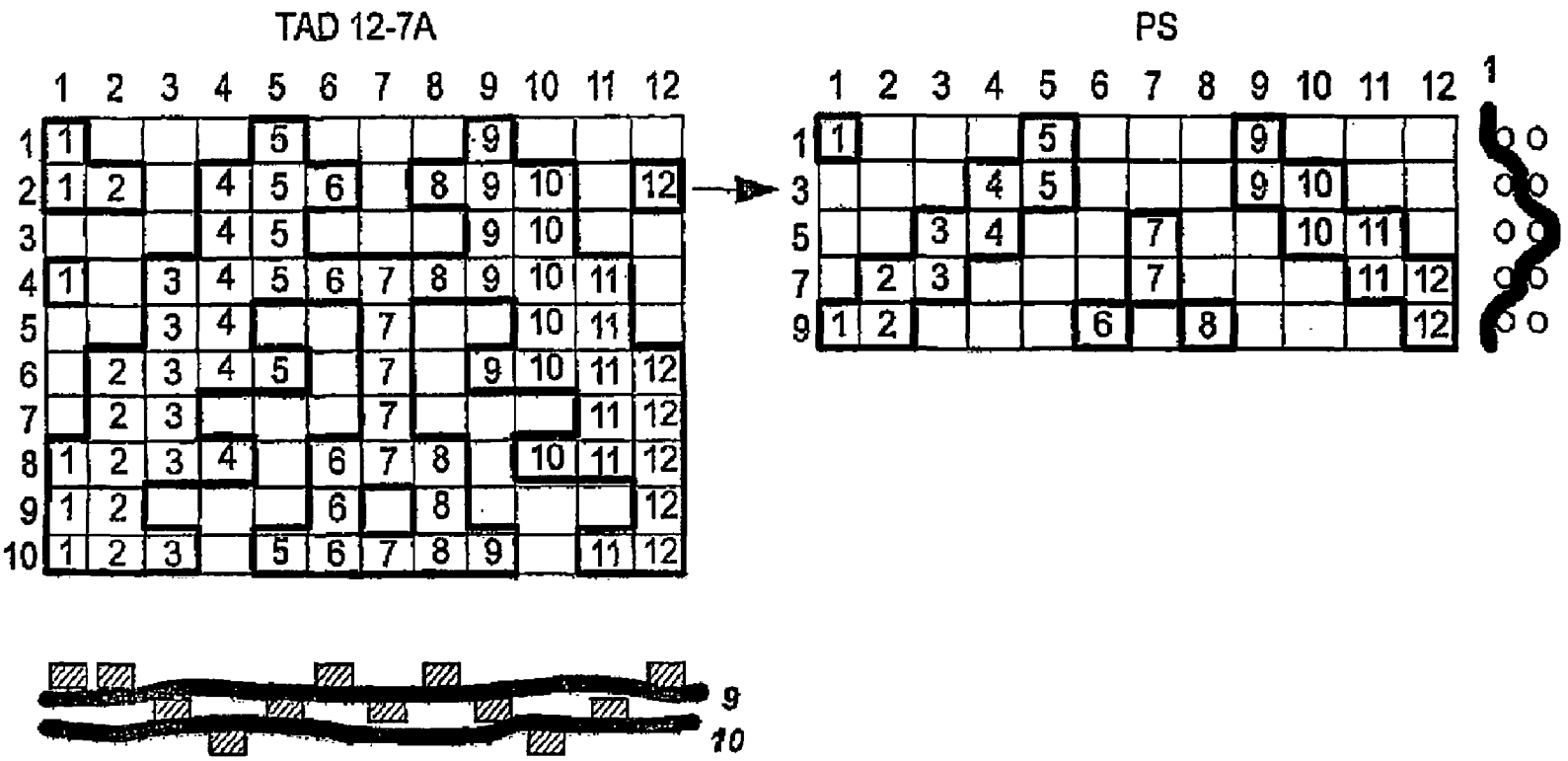
FIG. 5 is a weave pattern of the TAD fabric shown in FIG. 3.

By contrast, referring now to FIG. 3 and FIG. 4, photographs of a top view or paper sheet side surface of a TAD fabric, generally referenced 10, according to the present invention and a paper sheet, generally referenced 20, dried on the same, respectively, are shown. In FIG. 3, the top view of the TAD fabric 10 constructed according to the present invention shows a paper sheet side surface having a herringbone pattern with long warp yarn floats and a warp fill of 100%. The fabric 10 includes a single warp yarn system from only one set of warp yarns, which is composed of a multiplicity of warp yarns 12 positioned at substantially right angles to a multiplicity of weft yarns 14 forming a weft yarn system that is comprised of two sets of weft yarns; the individual weft yarns in one set of weft yarns are vertically stacked over those in the other set. The sheet produced by this fabric shown in FIG. 4, demonstrates the embossed pattern formed by the paper sheet contact with the warp yarn floats on the paper sheet side of the fabric as well as any paper side weft yarn floats that impact the fabric as well. FIG. 5 is a weave pattern layout for producing the TAD fabric shown in FIG. 3.

In a preferred embodiment, the TAD fabric constructed according to the present invention provides a multilayer fabric with diagonal apertures formed within the fabric to produce a maximum fill based upon 100% coverage by a single warp yarn system and at least 75% coverage by a weft yarn system comprised of two sets of weft yarns whose members are vertically stacked with respect to each other, which interlace at substantially right angles to each other in a pattern that forms a fabric plane, wherein the warp yarn height is maintained above the weft yarn height respective to the fabric plane with no embedment of the warp yarns, except that portion of the warp yarn at the ends of the floats, into the weft yarns and having a high air permeability for providing increased paper sheet bulk and high drying rates without negatively affecting paper machine running parameters.

In particular, the air permeability is preferably at least 450 cfm (cubic feet per minute per square foot) or at least about 7300 $m^3/m^2$ h (cubic meters per square meter per hour).

Regarding the warp yarn system, the maximum warp fill is produced by establishing 100% warp fill according to the equation:

$$\text{warp fill}=(\text{strand width})\times(\text{number of strands})/(\text{unit fabric width})\times 100.$$

Additional discussion of warp fill is provided within U.S. Pat. Nos. 4,290,209 at column 2 and 5,103,874 at column 4. Similarly, the weft fill is preferably at least 75%, according to the same equation.

Notably, the relationship between the warp and weft yarn systems is critical to the present invention. More specifically, in the present invention the warp yarns are embodied within the fabric plane in such a weave pattern as to provide warp floats on the paper side planar surface of the fabric. Weave patterns or designs that may be employed for this purpose include herringbone patterns, fancy twills, nested diamonds, and the like, which emboss a predetermined pattern onto the paper sheet as the TAD fabric is used to support and convey the paper on the TAD section of a paper machine. While the particular warp paths through the fabric for these weave patterns or designs may vary slightly, e.g., two adjacent warp yarns may have different crimp configurations, geometries, and/or dimensions, it is important that: (a) the fabric is woven according to a predetermined pattern that will create diagonal apertures within the fabric structure, i.e., the fabric design or weave pattern creates diagonal apertures or pathways within the fabric structure between the PS and MS planar surfaces of the fabric such that air can pass therethrough, and (b) the weft yarns are of sufficient size, e.g., from about 0.5 mm to about 1.2 mm, so as to make these warp yarn floats stand above the fabric plane. During operation of the paper machine, as air passes through the fabric's diagonal apertures, which are created by the combination of weave pattern, warp yarn fill and dimensions, and weft yarn fill and dimensions, and which establish a minimum air permeability of at least about 450 cfm or at least about 7300 $m^3/m^2/h$, the air essentially "pastes" the web onto the PS surface of the TAD fabric, forcing the paper sheet onto the PS surface of the fabric, thereby forming an embossed pattern on the paper sheet that corresponds to the yarn floats that are arranged in a predetermined pattern of the fabric's sheet side surface. It is these yarn floats, particularly those formed by the warp yarns, which, in combination with the air permeability, create the impressions in the paper sheet that impart bulk to the sheet. The fabrics according to the present invention produce a sheet having between about 50% to about 200% increased bulk when compared to prior art fabrics traditionally used in the TAD section of paper machines. Typically, the fabrics according to the present invention are used with tissue paper sheets having basis weights of 35–45 grams per square meter (gsm) for 2-ply tissue paper and 20–25 gsm for single ply tissue paper; however, other applications of the present invention are also possible.

Furthermore, the fabric construction according to the present invention provides diagonal apertures within the fabric structure, which create passageways or arc paths that are formed to allow for air passage through the paper sheet, then through the fabric and into the TAD porous suction roll, which essentially "pastes" or forces the paper sheet onto the fabric sheet side surface, thereby embossing the paper sheet with the fabric warp yarn floats that are arranged in a predetermined pattern. Some interlacing of the warp yarns and weft yarns is necessary on the machine side surface of the multilayer fabric in order to ensure the integrity of the fabric within the fabric plane. Significantly, in the predetermined weave pattern for the fabric the warp yarns must be arranged so as to pass between at least one pair of wefts arranged as a vertical stack, which forms the fabric thickness, thereby providing a warp float on each weft vertical stack on the machine side surface of the fabric.

Additionally, the fabric construction includes a high weft geometry, i.e., within the multilayer fabric design, the cross sectional diameter of the weft yarns, particularly as taken within the context of a multilayer fabric, is selected for a substantially large weft diameter to provide a warp yarn float height that is above the fabric plane on the PS so that there is no embedment of the warp yarns into the weft yarns, except that portion of the warp yarn at the ends of the floats. This selection of weft yarn dimensions within the fabric construction combines to ensure that the 100% warp fill and the diagonal apertures formed within the fabric structure produce a significant air permeability and substantial air passages within the fabric plane. Notably, it is also possible to use a single warp system wherein each warp system includes two separate yarns running together in a conjoined manner so as to be stacked on one another in pairs with no intervening yarns, thereby producing a warp fill of approximately 200% to 220% warp fill. These factors of warp crowd, weft yarn diameter, air permeability, and diagonal apertures within the fabric interact to produce the specific embossing patterns on the paper sheet and the substantially increased bulk properties of the sheet without compromising other paper machine running parameters or other paper sheet properties.

In a preferred embodiment, the warp yarns employ flat or substantially rectangular warp yarn cross sectional area having dimensions between about 0.25 mm×1.10 mm and about 0.60 mm×2.40 mm, more preferably about 0.33 mm×0.66 mm, with weft yarns having round cross sections of various sizes, depending upon the desired fabric air permeability. Preferably, the weft yarn cross sectional dimension are between about 0.50 mm and about 1.20 mm Also, more than one weft yarn size may be employed within a given fabric. Also typically, the fabrics according to the present invention incorporate heat-resistant polymeric yarns, such as polyphenylene sulfide (PPS), in order to extend fabric life, although other high performance synthetic yarns may be advantageously employed.

The bulk or specific volume of paper sheets is measured as the reciprocal of density. If the effective thickness of a sheet is measured using light pressure, then the bulk is defined as follows:

$$B = \frac{t}{BW} \times 10^3 \ (\mathrm{cm}^3/\mathrm{g})$$

where B=Bulk t=Effective Thickness (mm)

BW=Basis Weight (gsm)

In order to quantify the effect of various embossing fabric designs on bulk for assessing the effectiveness of the present invention for providing increased bulk to a paper sheet, a new test was developed to measure the effective sheet thickness. For this test, the sheet sample was placed between a flat steel platen and a Lucite block having an area just slightly less than the sheet. A dial gauge, set to "zero" when in contact with the Lucite block with no sheet present, was used to measure the effective sheet thickness.

Based upon this test procedure, surprisingly, the bulk for the paper sheets produced using the present invention were increased between about 50% to about 200% over that of the prior art fabrics. More particularly, the bulk increase was correlated to the increase of air permeability in the TAD fabrics constructed according to the present invention, as set forth in the foregoing. The combination and interaction of fabric air permeability greater than about 450 cfm or at least about 7300 $m^3/m^2/h$, weft yarn diameter, warp fill of about 100% and weft fill of at least about 75%, and multilayer fabric weave patterns having long warp floats and diagonal apertures within the fabric structures, together provided the surprisingly advantageous relationship between these fabric properties and increased sheet bulk, while also providing sufficient sheet absorbancy and CD stretch of the paper sheet without compromising paper machine running parameters.

Also, this invention further provides a method of using the TAD fabric of the present invention for forming a paper sheet having increased bulk and a predetermined embossed pattern. First, a TAD fabric is provided for use in a through-air drying section of a paper machine for assisting with drying and conveying the paper sheet. As set forth in the foregoing, this TAD fabric includes a multilayer synthetic fabric with diagonal apertures formed within the fabric to produce a maximum fill of between about 100% to about 220% coverage by a warp yarn system and at least about 75% coverage by a weft yarn system. The fabric's warp and weft yarn systems interlace at substantially right angles to each other in a pattern that forms a fabric plane, wherein the warp yarn height is maintained above the weft yarn height respective to the fabric plane with no embedment of the warp yarns, except that portion of the warp yarn at the ends of the floats, into the weft yarns. Also, the warp yarn height is maintained above the weft yarn height respective to the fabric plane with no embedment of the warp yarns, except that portion of the warp yarn at the ends of the floats, into the weft yarns thereby providing a warp yarn height above the paper side planar surface of the fabric according to the formula $$\text{Warp yarn height } (H) = (0.3 \text{ to } 1.5) \times h,$$

where h is the thickness of a rectangular warp yarn above the weft yarns on the paper side planar surface of the fabric. Furthermore, this fabric has a high air permeability, preferably at least about 450 cfm or at least about 7300 $m^3/m^2/h$.

Next, during operation of the paper machine, as air passes through the fabric's diagonal apertures, which are created by the combination of weave pattern, warp yarn fill and dimensions, and weft yarn fill and dimensions, and which establish a minimum air permeability of at least about 450 cfm or at least about 7300 $m^3/m^2/h$ (cubic meters per square meter per hour), the air essentially "pastes" the web onto the PS surface of the TAD fabric, forcing the paper sheet onto the PS surface of the fabric, thereby forming an embossed pattern on the paper sheet that corresponds to the yarn floats of the fabric's PS planar surface. It is the raised surfaces formed by at least the warp floats on the paper side planar surface of the fabric and any weft yarns floats on the paper side planar surface of the fabric, which in combination with the air permeability of the fabric, create the impressions in the paper sheet that impart bulk to the sheet. The fabrics according to the present invention produce a sheet having between about 50% to about 200% increased bulk when compared to prior art fabrics traditionally used in the TAD section of paper machines. More particularly, the fabrics according to the present invention, when used to dry and convey tissue paper sheets having basis weights of 35–45 grams per square meter (gsm) for 2-ply tissue paper and 20–25 gsm for single ply tissue paper, produce a resultant tissue paper sheet with bulk properties that are proportional to the increase in air permeability, increase in warp yarn height or "proudness" and increase in the amount of openness formed by the diagonal apertures within the fabric and the interaction of these factors.

Figure 6:
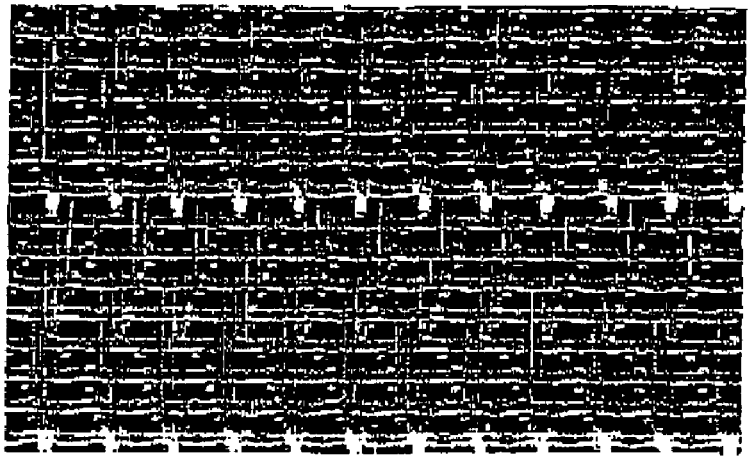
FIG. 6 is a photograph of a top view of an alternative TAD fabric constructed according to the present invention.
Figure 7:
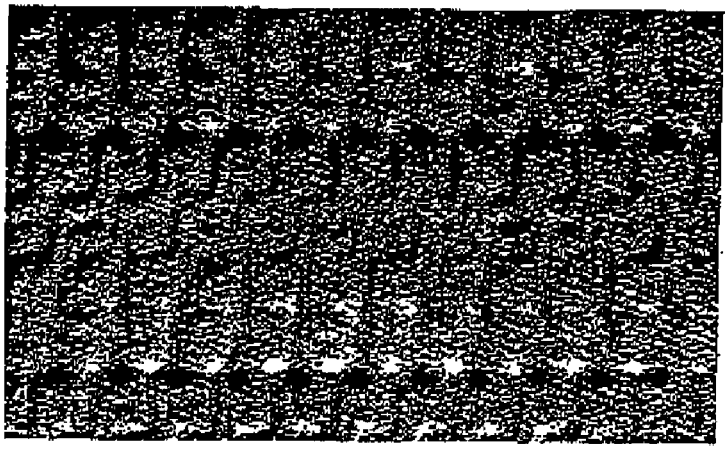
FIG. 7 is a photograph of a paper sheet dried on the TAD fabric of the present invention shown in FIG. 6.
Figure 8:
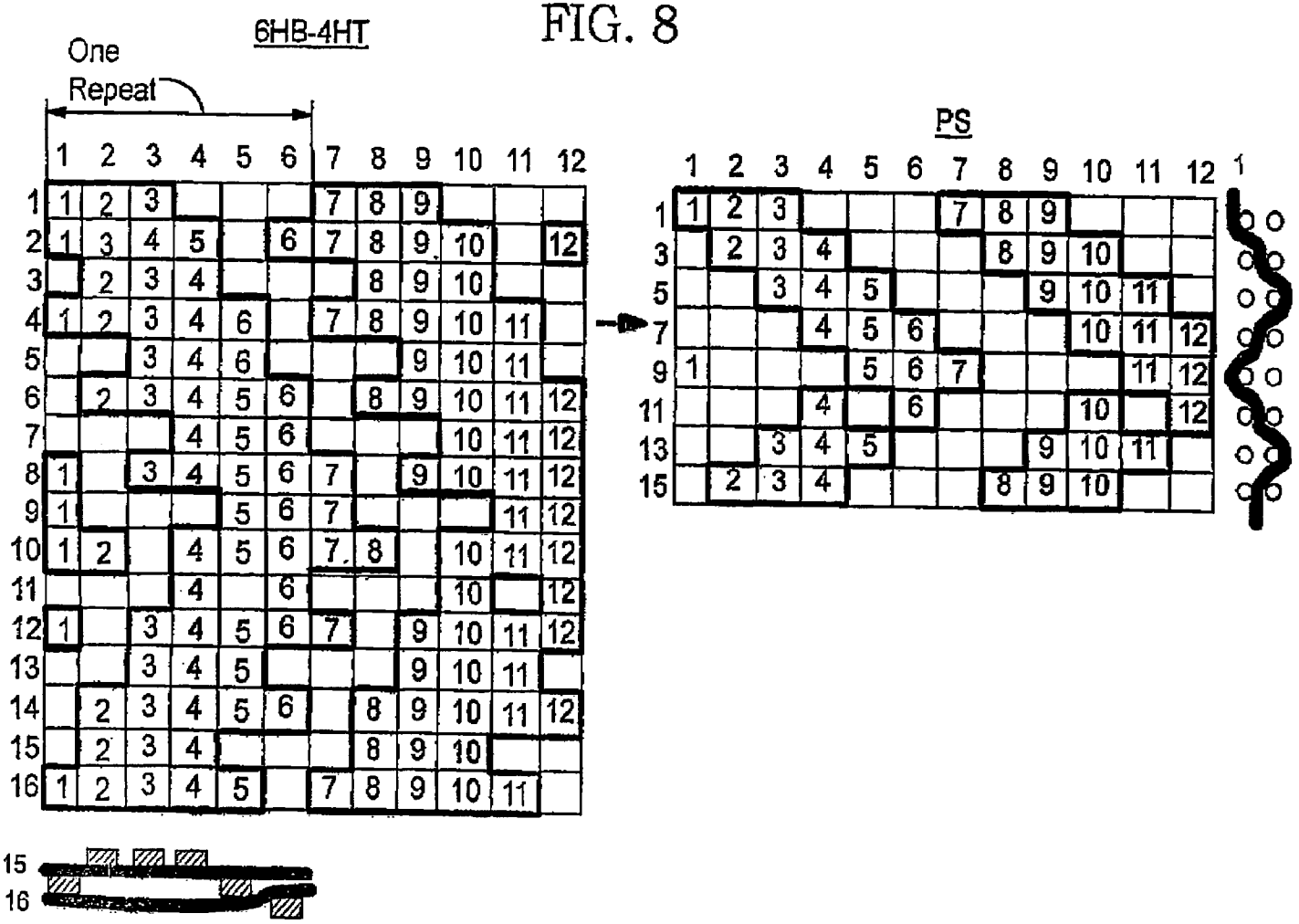
FIG. 8 is a weave pattern of the TAD fabric shown in FIG. 6.
Figure 9:
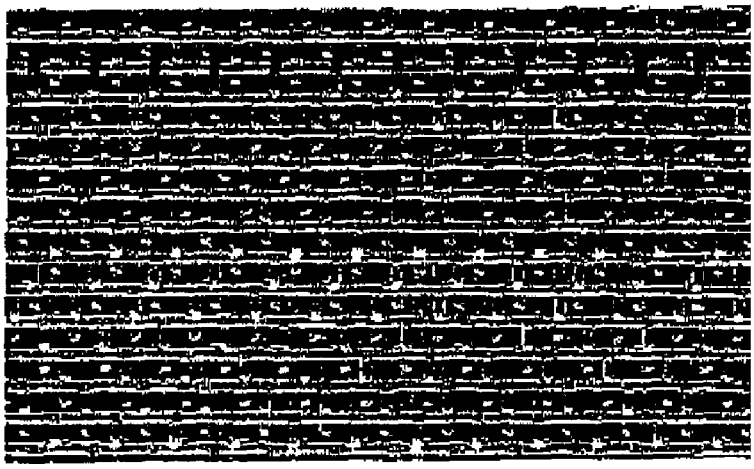
FIG. 9 is a photograph of a top view of an alternative TAD fabric constructed according to the present invention.
Figure 10:
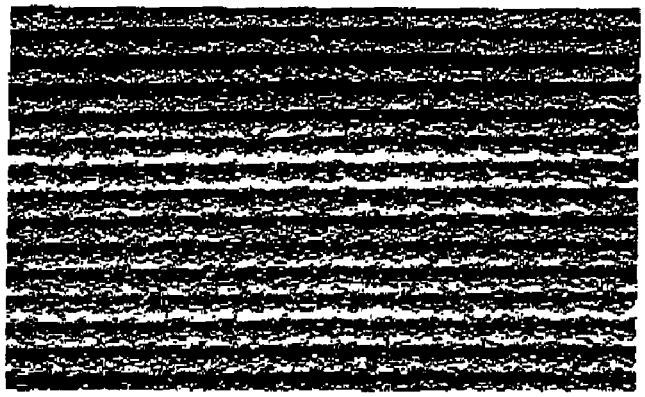
FIG. 10 is a photograph of a paper sheet dried on the TAD fabric of the present invention shown in FIG. 9.
Figure 11:
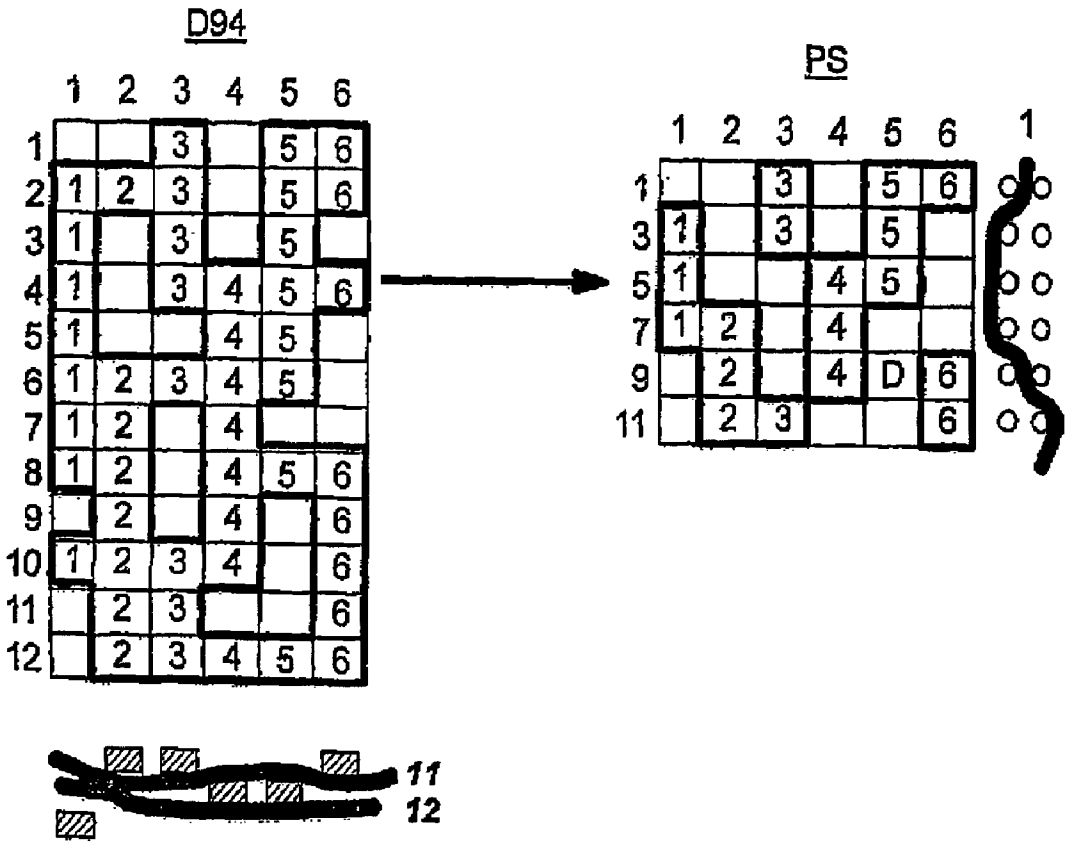
FIG. 11 is a weave pattern of the TAD fabric shown in FIG. 9.
Figure 12:
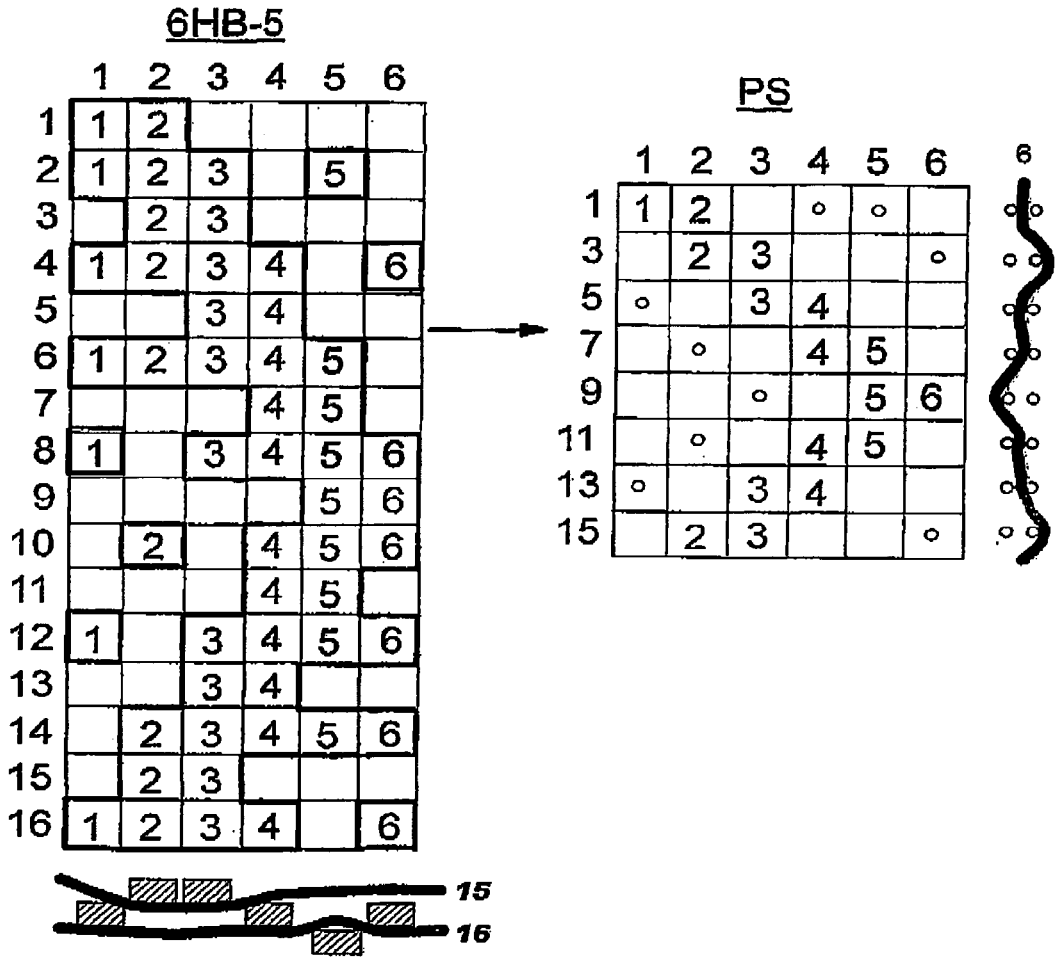
FIG. 12 is a weave pattern of another TAD fabric embodiment according to the present invention.
Figure 13:
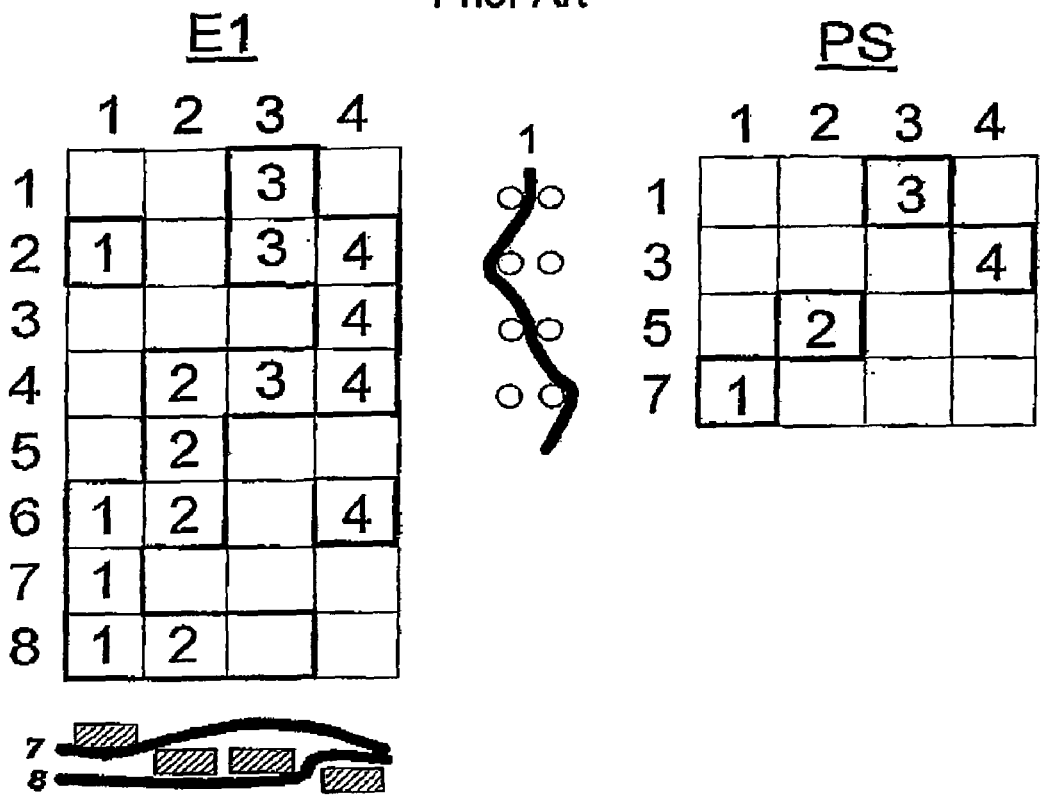
FIG. 13 Prior Art
FIG. 13 shows a PRIOR ART weave pattern.

Furthermore, a method for manufacturing a TAD fabric to provide increased bulk and a predetermined embossed pattern of the paper sheet is set forth according to the present invention. First, at least one synthetic warp yarn system is provided in which the warp yarns have a flat or substantially rectangular warp yarn cross sectional area having dimensions between about 0.25 mm×1.10 mm and about 0.60 mm×2.40 mm, more preferably about 0.33 mm×0.66 mm. Then weft yarns are introduced at substantially right angles to the warp yarn system and interlace therewith to form a fabric structure with diagonal apertures within the fabric, wherein the warp yarn height is maintained above the weft yarn height respective to the fabric plane with no embedment of the warp yarns, except that portion of the warp yarn at the ends of the floats, into the weft yarns. Also, the warp yarn height is maintained above the weft yarn height respective to the fabric plane with no embedment of the warp yarns, except that portion of the warp yarn at the ends of the floats, into the weft yarns thereby providing a warp yarn height according to the formula (0.3 to 1.5)×h, where h is the height of a rectangular warp yarn above the weft yarns. The weft yarns preferably have round cross sections of various sizes, preferably between about 0.50 mm and about 1.20 mm, depending upon the desired fabric air permeability, which is at least about 450 cfm or at least about 7300 $m^3/m^2/h$. Also, more than one weft yarn size may be employed within a given fabric. Also typically, the fabrics according to the present invention incorporate heat-resistant polymeric yarns, such as polyphenylene sulfide (PPS), in order to extend fabric life, although other high performance synthetic yarns such as polyether ether ketone (PEEK) may be advantageously employed. The fabric is heat set and/or otherwise thermally heat treated in order to provide stability of fabric dimensions and fabric running properties on the paper machine. By way of example, some weaving patterns used for establishing the warp and weft yarn interlacing that provide limited embedment of the warp yarns into the weft yarns are shown in FIG. 5. Similarly, FIGS. 6 and 9 are photographs showing the top view of the PS of the fabric and illustrate alternative fabric designs constructed according to the present invention, with similar attributes as those set forth in the fabric design of FIG. 3, as set forth in the foregoing. FIGS. 7 and 10 show photographs of paper sheets having been dried with the fabric designs of FIGS. 6 and 9, respectively, as set forth in the foregoing; the embossment of the fabric yarn floats on the paper side planar surface of the fabric are evident on the paper sheet surface. Finally, FIGS. 8 and 11 illustrate weave pattern diagrams for the repeat patterns of the fabrics of FIGS. 6 and 9, respectively.

The present invention is thus further directed to a method for manufacturing an industrial fabric for through-air dryer sections of a paper machine to provide increased bulk and a predetermined embossed pattern of a paper sheet including the steps of:

providing a system of warp and weft yarns;

interweaving the warp and weft yarns according to a predetermined pattern, wherein:

a) the warp and weft systems are each comprised of at least one set of yarns which are interwoven according to the predetermined pattern which forms a paper side planar surface and a machine side planar surface and which maintains the component yarns of each set in vertically stacked alignment throughout the fabric;

b) the sets of warp and weft yarns are interwoven to provide diagonal apertures within the fabric;

c) the air permeability of the fabric is at least about 7300 $m^3/m^2/h$;

d) the warp fill of the fabric is at least 100%;

e) the weft fill of the fabric is at least 75%;

f) the predetermined pattern is selected so that the at least one set of warp yarns is interwoven with the at least one set of weft yarns so as to form warp yarn floats which pass over at least two weft yarns in the paper side planar surface without interweaving; and g) the height of the warp yarn floats above the planar surface being from about (0.3 to 1.5)×h, where h is the thickness of the yarn; and forming a seamable region in the fabric such that the fabric may be installed on a paper machine through-air dryer section to form a continuous loop thereon.

Certain modifications and improvements will occur to those skilled in the art upon a reading of the foregoing description. By way of example, the TAD fabrics of the present invention overcome the limitations of fabrics of the prior art by providing a combination of mechanical properties, air permeability and paper-side surface topography that allow stable runnability on the TAD to be realized while increasing drying rates and sheet bulk. Another practical advantage of them compared to fabrics of the prior art is that they can be made with a pin or intermeshed coil seam, as is required for many of the TAD sections on paper machines. All modifications and improvements have been deleted herein for the sake of conciseness and readability but are properly within the scope of the following claims.

EXAMPLES

In order to further illustrate the present invention, three examples of alternative preferred embodiments were constructed according to the present invention as set forth in the foregoing under FIGS. 3–11, specifically in three TAD fabric designs, identified as 12-7A, 6HB-4HT, and D94. The 12-7A embodiment of the present invention was woven in 12 harnesses; in this design, the paper-side imprint pattern is a horizontal (CD) herring-bone which repeats every 5 paper-side wefts. The 6HB-4HT embodiment of the present invention was woven in 6 harnesses; in this design example the imprint pattern is an MD herring-bone in which 5 of the 6 warp yarns in a pattern float over at least 3 paper-side wefts. The D94 embodiment of the present invention was woven in 6 harnesses; the paper-side imprint pattern of this design is a broken twill in which every warp yarn in a pattern repeat floats over 3 paper-side wefts.

The fabric air permeability and warp yarn float height or "warp proudness" were measured and recorded. These fabrics were used to dry paper sheet samples and the resultant paper sheet bulk values were measured and recorded, as set forth in Table 1 below. The relationship between the fabric properties of air permeability and warp yarn float height, combined with the diagonal apertures within the fabric based upon the design selected, interact to produce a directly proportional increased paper sheet bulk.

TABLE 1

| Sample Identification | Fabric Design | Fabric Air Permeability ($cfm/ft^2$) | Fabric Air Permeability ($m^3/m^2/h$) | Fabric Warp Yarn Float Height (mm) | Resultant Paper Sheet Bulk (cc/g) |
|---|---|---|---|---|---|
| EXAMPLE 1 | 12-7A | 570 | 9250 | 0.13 | 10.8 |
| | | 630 | 10220 | 0.31 | 12.6 |
| | | 660 | 10710 | 0.43 | 13.9 |
| EXAMPLE 2 | 6HB-4HT | 580 | 9420 | 0.24 | 13.4 |
| | | 685 | 11120 | 0.37 | 17.1 |
| EXAMPLE 3 | D94 | 615 | 10000 | 0.29 | 9.9 |
| | | 660 | 10710 | 0.40 | 11.1 |

Figure 14:
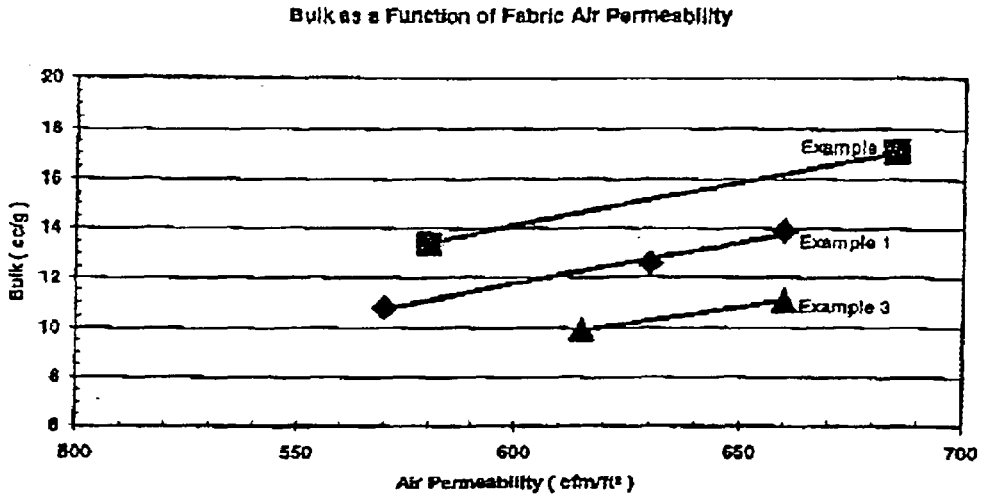
FIG. 14 shows a chart representing bulk as a function of fabric air permeability.

Additionally, for each of the fabrics in Examples 1, 2, and 3 described hereinabove, the direct relationship between the fabric property of air permeability, combined with the diagonal apertures within the fabric based upon the design selected, is shown; specifically, wherein the air permeability increases a proportional increase in paper sheet bulk is effected, as shown in FIG. 14.

We claim:

1. An industrial fabric comprising a system of warp and weft yarns interwoven according to a predetermined pattern, wherein:

a) the warp and weft systems are each comprised of at least one set of yarns which are interwoven according to the predetermined pattern which forms a paper side planar surface and a machine side planar surface and which maintains the component yarns of each set in vertically stacked alignment throughout the fabric;

b) the sets of warp and weft yarns are interwoven to provide diagonal apertures within the fabric;

c) the air permeability of the fabric is at least about 7300 $m^3/m^2/h$;

d) the warp fill of the fabric is at least 100%;

e) the weft fill of the fabric is at least 75%;

f) the predetermined pattern is selected so that the at least one set of warp yarns is interwoven with the at least one set of weft yarns so as to form warp yarn floats which pass over at least two weft yarns in the paper side planar surface without interweaving; and g) the height of the warp yarn floats above the paper side planar surface being from about (0.3 to 1.5)×h, where h is the thickness of the yarn.

2. A fabric according to claim 1 wherein the warp system is comprised of one set of yarns.

3. A fabric according to claim 1 wherein the warp system is comprised of two sets of yarns and the warp fill is between about 200% to about 220%.

4. A fabric according to claim 1 wherein the warp yarns have a substantially rectangular cross section.

5. A fabric according to claim 1 wherein the yarns comprising the sets of weft yarns are vertically stacked.

6. A fabric according to claim 3 wherein the yarns of one set are in stacked vertical relationship throughout the fabric.

7. A method of using an industrial fabric for through-air dryer sections of a paper machine for forming a paper sheet having increased bulk and a predetermined embossed pattern, comprising the steps of:

installing the industrial fabric to form a continuous loop on a paper machine through-air dryer section and operating the machine with the fabric running in a machine direction thereon, wherein the industrial fabric comprises a system of warp and weft yarns interwoven according to a predetermined pattern, wherein:

a) the warp and weft systems are each comprised of at least one set of yarns which are interwoven according to the predetermined pattern which forms a paper side planar surface and a machine side planar surface and which maintains the component yarns of each set in vertically stacked alignment throughout the fabric;

b) the sets of warp and weft yarns are interwoven to provide diagonal apertures within the fabric;

c) the air permeability of the fabric is at least about 7300 $m^3/m^2/h$;

d) the warp fill of the fabric is at least 100%;

e) the weft fill of the fabric is at least 75% f) the predetermined pattern is selected so that the at least one set of warp yarns is interwoven with the at least one set of weft yarns so as to form warp yarn floats which pass over at least two weft yarns in the paper side planar surface without interweaving; and g) the height of the warp yarn floats above the paper side planar surface being from about (0.3 to 1.5)×h, where h is the thickness of the yarn.

8. A method for manufacturing an industrial fabric for through-air dryer sections of a paper machine to provide increased bulk and a predetermined embossed pattern of a paper sheet comprising the steps of:

providing a system of warp and weft yarns;

interweaving the warp and weft yarns according to a predetermined pattern, wherein:

a) the warp and weft systems are each comprised of at least one set of yarns which are interwoven according to the predetermined pattern which forms a paper side planar surface and a machine side planar surface and which maintains the component yarns of each set in vertically stacked alignment throughout the fabric;

b) the sets of warp and weft yarns are interwoven to provide diagonal apertures within the fabric;

c) the air permeability of the fabric is at least about 7300 $m^3/m^2/h$;

d) the warp fill of the fabric is at least 100%;

e) the weft fill of the fabric is at least 75%;

f) the predetermined pattern is selected so that the at least one set of warp yarns is interwoven with the at least one set of weft yarns so as to form warp yarn floats which pass over at least two weft yarns in the paper side planar surface without interweaving; and g) the height of the warp yarn floats above the planar surface being from about (0.3 to 1.5)×h, where h is the thickness of the yarn; and forming a seamable region in the fabric such that the fabric may be installed on a paper machine through-air dryer section to form a continuous loop thereon.

* * * * *

UNITED STATES PATENT AND TRADEMARK OFFICE

CERTIFICATE OF CORRECTION

PATENT NO. : 7,114,529 B2
APPLICATION NO. : 10/482182
DATED : October 3, 2006
INVENTOR(S) : Johnson et al.

It is certified that error appears in the above-identified patent and that said Letters Patent is hereby corrected as shown below:

ON THE TITLE PAGE

At section (52), 1st line, delete "439/383 R" and insert therefor --139/383 R--.

IN THE SPECIFICATION

At column 5, line 67, delete "(cfm/ft2)" and insert therefor --(cfm/$ft^2$)--.

At column 6, line 13, after the word "distance", delete "d" and insert therefor -- D --.

At column 7, line 33, after the word "about", delete "7300 $m^3/m^2$ h" and insert therefore -- 7300 $m^3/m^2/h$ --.

At column 9, line 4, after the "1.20 mm", insert therefore --.--.

UNITED STATES PATENT AND TRADEMARK OFFICE

CERTIFICATE OF CORRECTION

PATENT NO. : 7,114,529 B2
APPLICATION NO. : 10/482182
DATED : October 3, 2006
INVENTOR(S) : Johnson et al.

It is certified that error appears in the above-identified patent and that said Letters Patent is hereby corrected as shown below:

IN THE DRAWINGS

Replace Figure 8 with Figure 8 as shown below:

--

FIG. 8

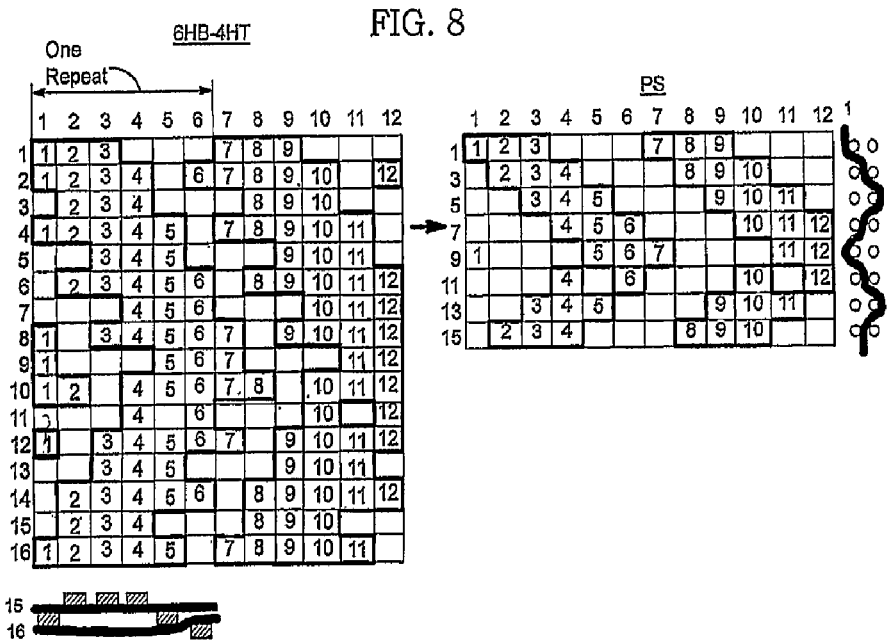

--

Signed and Sealed this

Twelfth Day of June, 2007

JON W. DUDAS
*Director of the United States Patent and Trademark Office*